US008192127B2

(12) United States Patent
Angman

(10) Patent No.: US 8,192,127 B2
(45) Date of Patent: Jun. 5, 2012

(54) TUBULAR HANDLING SYSTEM FOR DRILLING RIGS

(76) Inventor: Per Angman, Calgary (CA)

( * ) Notice: Subject to any disclaimer, the term of this patent is extended or adjusted under 35 U.S.C. 154(b) by 256 days.

(21) Appl. No.: 12/324,790

(22) Filed: Nov. 26, 2008

(65) Prior Publication Data

US 2009/0136326 A1 May 28, 2009

Related U.S. Application Data

(60) Provisional application No. 60/990,087, filed on Nov. 26, 2007.

(51) Int. Cl.
*E21B 19/00* (2006.01)
*E21B 19/15* (2006.01)

(52) U.S. Cl. ..... 414/22.52; 104/112; 414/782; 414/605; 212/122; 212/98; 212/72

(58) Field of Classification Search ..... 104/112–113, 104/115–116; 175/52, 85; 212/122, 273, 212/75; 414/139.4, 139.5, 22.51–22.59, 414/22.61–22.63, 22.68, 22.71, 23–24, 605, 414/779, 782, 919; 89/1.805
See application file for complete search history.

(56) References Cited

U.S. PATENT DOCUMENTS

| | | | | | |
|---|---|---|---|---|---|
| 890,317 | A | * | 6/1908 | Wadsworth | 414/24 |
| 1,693,208 | A | * | 11/1928 | Nelson | 212/98 |
| 1,714,183 | A | * | 5/1929 | McPhee | 104/112 |
| 3,333,713 | A | * | 8/1967 | Cruciani | 212/76 |
| 3,368,699 | A | | 2/1968 | Scaggs | |
| 3,532,229 | A | | 10/1970 | Scaggs | |
| 3,613,905 | A | | 10/1971 | Woolslayer et al. | |
| 3,651,955 | A | * | 3/1972 | Shkredka | 414/779 |
| 3,651,959 | A | * | 3/1972 | Castela et al. | 414/22.58 |
| 3,675,794 | A | * | 7/1972 | Ingram et al. | 414/138.3 |
| 3,713,547 | A | * | 1/1973 | Beck | 414/22.52 |
| 3,825,129 | A | | 7/1974 | Beck | |
| 3,865,256 | A | | 2/1975 | Freeman, Sr. | |
| 4,040,524 | A | | 8/1977 | Lamb et al. | |
| 4,053,063 | A | | 10/1977 | Harper, Jr. | |
| 4,054,210 | A | * | 10/1977 | Crocker | 414/22.52 |
| 4,163,480 | A | * | 8/1979 | Highland | 182/14 |
| 4,303,270 | A | * | 12/1981 | Adair | 294/88 |
| 4,348,960 | A | | 9/1982 | Staurseth | |
| 4,473,011 | A | * | 9/1984 | Wuschek | 104/173.1 |
| 4,625,796 | A | * | 12/1986 | Boyadjieff | 166/77.52 |
| 4,754,886 | A | * | 7/1988 | Hirano | 212/76 |
| 4,756,431 | A | | 7/1988 | Hirano | |
| 5,127,790 | A | | 7/1992 | Teague | |
| 5,515,789 | A | | 5/1996 | Brochand et al. | |
| 5,915,906 | A | * | 6/1999 | Lucking et al. | 414/142.8 |
| 6,471,191 | B1 | | 10/2002 | Rotzler et al. | |
| 6,860,694 | B2 | | 3/2005 | Slettedal | |
| 7,370,769 | B2 | | 5/2008 | Picard et al. | |
| 2003/0170095 | A1 | * | 9/2003 | Slettedal | 414/22.59 |

* cited by examiner

*Primary Examiner* — Gregory Adams
(74) *Attorney, Agent, or Firm* — Sean W Goodwin

(57) ABSTRACT

A cableway transport system for moving tubulars between a supply of tubulars and a rig mast implements a gondola suspended and movable along load cables. The gondola is fit with grippers for carrying tubulars between the rack and mast. The gondola has a first landing coupler which is received and releasably couples to a second landing coupler on the mast for forming a landing connection. The landing connection enables rotation of the gondola to align the carried tubular with the wellhead. The grippers can be individually actuable to allow finer alignment of the tubular above the wellhead.

15 Claims, 11 Drawing Sheets

TUBULAR HANDLING SYSTEM FOR DRILLING RIGS

CROSS-REFERENCE TO RELATED APPLICATIONS

This application is a non-provisional application of U.S. 60/990,087 filed Nov. 26, 2007, the entirety of which is incorporated by reference herein.

FIELD OF THE INVENTION

This invention relates to pipe handling systems. More particularly, this invention relates to a cableway transport system for handling tubulars between a supply of tubulars and a rig mast.

BACKGROUND OF THE INVENTION

One of the central functions of an oil and gas well drilling rig or platform is to handle drill string tubulars or pipes for drilling operations and casing running operations. These are very labour intensive operations, particularly on drilling rigs on land. These are also operations that are fraught with opportunities for the workers to get injured. Statistics show that that a large percentage of the accidents that happen on drilling rigs are associated with handling drill string tubulars.

Traditional pipe handling on drilling rigs or derricks has evolved over many years. Pipe handling methodologies or procedures have been developed around the idea of a very well coordinated drilling crew that learned how to handle pipe in very specific ways using very specific tools and procedures. These procedures have been well established over the years with each crew member having a specific function in the overall process.

A typical pipe handling operation involves retrieving and storing drill string tubulars (and casing) on pipe racks or in pipe tubs located adjacent a drilling rig catwalk. A drill pipe or tubular is usually manually rolled onto the catwalk by two or three workers. If the pipe is inside a pipe tub they are usually raised to the catwalk level by a hydraulic mechanism and rolled from the tub to the catwalk by workers.

A worker wraps a cat line (a simple hoisting line suspended from the derrick) around an end of the pipe and the pipe is then dragged up a v-door into a position straddling the drilling rig floor and the catwalk. From this position, the pipe may remain there or be immediately lifted up and lowered into a "mouse hole". Once in the mouse hole, the pipe is added to the overall drill string in a procedure known as "making a connection" to increase the length of the drill string. This operation is repeated as necessary.

At different depths of the well, for a variety of reasons, a drill string may be required to be withdrawn in a procedure called "tripping out". The drill string is hoisted up one segment, or pipe stand, at a time. The pipe stand, which may include multiple joints of pipe, is then "broken off" (disconnected or un-threaded) from the drill string and moved sideways and "racked back" in a racking board (sometimes call monkey board). The racking board is attached to the drilling rig mast itself. The set back area is supported by the substructure. This process is repeated until the entire drill string has been pulled out of the hole. The process may require hundreds of pipe stands to be tripped out and racked back depending on the length of the drill string and the height of the derrick (in single, double or triple stands).

Racking back is usually done manually by workers. Once a pipe stand has been broken off, workers push the bottom end of the stand over to the set back area on the drill floor and carefully lowers a bottom end of the pipe stand onto the floor. The top end of the stand is disconnected from the rig hoisting system and the top end of the stand is moved (manually pulled over by the derrick man) into the racking board and racked between the fingers in the finger board.

The stands must be positioned precisely so that they lean just the right amount to stay where they have been put but not so much that they put an undue side force on the derrick. The whole procedure is reversed for tripping into the hole.

At the end of a drilling operation, when the well has been drilled to total depth (TD), the drill string is tripped out one last time and "laid down". In this operation, only one single joint at a time (not a multiple joint stand) is pulled out of the hole, broken off and manually and laid down. This is a very time consuming process compared to tripping pipe into the racking board particularly on a big triple rig.

Most pipe handling equipment has been designed to mechanize some small part of the overall procedure. For example, iron roughnecks (power wrenches), for making and breaking of tool joints, were one of the first pieces of equipment to be developed. Other pieces of equipment have been developed to deal with other parts of the job. However, most of the equipment developed were not integrated with each other in an operational way. This is still done by the rig crew who operated each individual piece of equipment in a particular sequence.

Most of the current pipe handling equipment is built to augment, rather than replace, traditional pipe handling procedures. In other words, they do not change the fundamental way pipe is handled. Instead the tools do the same job, the same way a worker would do, except the tool allows the work to be performed faster, better, and safer. This way, the operation does not have to stop if a piece of equipment breaks down, the tool is simple set aside and a worker does the same job manually with manual tools. This redundancy is highly valued in a drilling operation for many reasons.

Many attempts have been made to automate or at least mechanize the handling of drill string tubulars. Most pipe handling systems are made up from several different pieces of equipment that are more or less coordinated with each other. However, as pipe handling requirements on drilling rigs are diverse, not one system has been developed that solves all of the safety and operational issues associated with handling drill string tubulars.

Pipe handling has been difficult to mechanize because of many factors which includes but is not limited to: 1) the diverse ways drill string tubulars or pipes have to be manipulated during various operational procedures; 2) the different types of tubulars a drilling rig has to handle (drill pipe, drill collars, casing, tubing); 3) the different types of downhole tools that have to be handled (DST tools, core barrels, mud motors, stabilizers, shock subs, jars etc); 4) the diverse sizes of tubulars a drilling rig has to be able to handle (2⅜" to 20" diameter); 5) the differing lengths of tubulars that have to be manipulated (2 feet to 93 feet); and 6) the differing weights of tubulars (100 lbs to 10,000 lbs) a drilling rig must handle.

As a result of the various requirements for each drilling rigs, most drilling rigs are currently custom built, more or less "fit for purpose", and intended to do a particular kind of drilling job that limits the range of diversity that the rig and equipment has to handle, making it easier to incorporate some pipe handling equipment into the rig design and mechanize some of the processes. Customization of drilling rigs for a particular job site is expensive and does not allow that customized drilling rig to be used at a different site with ease and without major modifications. The "general purpose" rig, more commonly used in the earlier days of oil and gas drilling, is more capable of handling a wider range of jobs.

The general purpose land rigs are typically divided in three large groups, for the purpose of rig size and depth capacity.

Small rigs, more commonly known as singles, are generally of 50-150 tonne capacity and capable of handling single (30-45 ft) joints of drilling tubulars. These drilling rigs are used to drill shallow wells in the range of 1,000-4,000 ft depth.

Medium rigs, more commonly known as doubles, are generally of 150-250 tonne capacity, capable of handling stands comprising double (60 ft) joints of drill pipe. These are used to drill medium depth wells between 3,000-8,000 feet. The derrick structures are typically taller to accommodate the longer drill string stands. For deeper wells, it is more efficient to have a taller rig with double stands, particularly for tripping operations. It is also necessary to have a taller derrick to rack back more drill string tubulars in the derrick.

Large rigs, known as triples, are generally of 250-750 tonne capacity, capable of handling stands comprising triple (90 ft) joints of drill pipe. These rigs drill deep depth wells between 6,000-30,000 feet. The derrick structures are usually taller then the medium rigs to accommodate the longer drill string stands. These rigs can accommodate even more drill pipe by racking back triple stands and these rigs also have larger floor areas to be able to rack back more stands in the derrick.

The vast differences in rig size and configurations have made it difficult to design a single ubiquitous pipe handling system that fits all sizes of rigs. Instead, two different general design paths for handling drill string tubulars have developed: one for handling drill pipes on single rigs, and one for handling drill pipes for double and triple rigs. The principal difference between these two paths is in the handling of drill string tubulars for tripping operations.

Many mechanized pipe arms have been developed for handling drill string tubulars for single rigs. These pipe arms differ from conventional systems in that instead of having a racking board and storing the drill string tubulars in the derrick for tripping, the pipe stands are picked up or laid down all the time by the pipe arm. The hydraulically powered arm grips pipe stands from the catwalk and lifts the stand directly into position above the wellhead for connection to the drill string. The intermediate steps of placing the stand in the mouse hole and placing the stand in the racking board are eliminated. However, if the hydraulically actuated pipe arm breaks down, the whole drilling process is delayed because workers cannot perform the pipe handling functions in a manual way. There is no V-door, catwalk or mouse hole associated with these types of pipe handling systems. The entire rig is not set up for conventional manual intervention.

These rigs are also usually fitted with top drives and iron roughnecks so that the stands can be spun in, and torqued up, hands free. The stands are never stored in the derrick and thus there is no need for a derrickman. A properly designed single rig with a pipe arm and other automation equipment (such as top drive, hydraulic elevators, link tilt, power wrench, pipe tubs, etc.) represents the most complete pipe handling system available on rigs today. It is also relatively simple.

However, there is a serious limitation with this arm design. It only works well on single rigs. Pipe arms are usually capable of only handling single stands, not the double and triple stands that are in use on bigger rigs. The arms would become too large and heavy if pipe arms are designed for double and triple stands.

The physical geometry of a drilling rig also makes it very difficult to use pipe arms on a high substructure because pipe arms cannot be made to reach up and over a drill floor that is 30-40 feet high. Still, because pipe arms have been so successful, more and more rigs are built as singles and are effectively competing with doubles (and in some case triples) on deeper wells.

For double and triple rigs, automation has been done in smaller discrete steps rather than large complete systems and follows the traditional approach of manually performing many operations with the assistance of mechanical tools. Top drives, power wrenches, pipe spinners have been introduced on these large rigs with good success. Unfortunately, most of the equipment developed for the double and triple rigs has not been integrated into a single system for handling pipes.

Typical double and triple rigs now have top drives, power wrenches, pipe spinners, rotating mouse holes for offline stand building and pipe tubs. These pieces of equipment mechanize certain parts of the pipe handling function but not all and not in an integrated way. The coordination of these separate tools is still done manually by workers who operate them.

More recent advances to the double or triple rigs were the implementation of power catwalks or pipe skates. These automated machines are a combination of the v-door and drilling rig catwalk. Hydraulically powered, power catwalks and pipe skates move the pipe stands from the catwalk position to the v-door. These power catwalks mechanize yet another (small) part of the pipe handling operation as well as assisting in casing running operations by picking up (at the start of the well) and laying down of the drill string (at the end of the well). The power catwalk has no function for tripping drill string since these rigs still rack back the stands in the derrick.

The latest piece of equipment to be introduced on double and triple rigs was the installation of some form of a manipulator arm that can lift a drill string stand from above a centerline of the wellbore and move it to the racking board during tripping out and tripping in operations. The manipulator arm, usually mounted on the racking board, replaces a derrickman and other servicemen on the drill floor and basically trips in and trips out drill stands mechanically.

However, the racking board mounted manipulator arm has some disadvantages. In order to perform any service work on the arm, a worker has to climb up 50-90 feet up in the air and work in a very exposed position. The arm has to be assembled and disassembled for moving the rig.

It is noted that on offshore drilling platforms, sophisticated pipe handling systems have been installed in order to increase operating efficiency and safety. On very large offshore rigs there have been a number of systems designed to mechanize the entire pipe handling process.

Such systems are only possible because the equipment for such systems can be permanently installed on the drilling rigs and do not have to be dismantled, transported on trucks between wells, and then reassembled at a different location, as is the case on land rigs.

The pipe handling systems on the offshore drilling rigs tend to be extremely complicated, large, slow and expensive. The systems require a lot of tuning and maintenance and is only possible on large offshore drilling platforms as these type of rigs usually have technicians, welders, mechanics and electricians on board at all times. It is not practical or economical to install offshore type pipe handling systems on land rigs.

There is still a need for a universal pipe handling system that can be used on most rigs regardless of size and purpose.

SUMMARY OF THE INVENTION

A gondola pipe-handling system is provided adapted to most rigs and tubular supplies. Precision handling issues associated with tension members, such as cables, are overcome avoided using apparatus and methodologies disclosed herein.

In embodiments of the invention, a gondola for carrying tubulars to a from a rig is suspended from a cable. At the rig, the gondola is landed at a connector enables, yet controls rotation of the gondola and tubular into the mast for receiving a tubular, such as a joint or stand of joints, tripped out of the from the well or for delivering a tubular for alignment with and running into the well.

In one aspect of the invention, a gondola is suspended from and movable along a load cable extending between a drill rig mast and a supply of tubulars. The gondola has a first landing coupler attached thereto, and grippers for releasably gripping drill string tubulars. A second landing coupler, supported by the rig mast, receives and releasably couples with the first landing coupler to form a landing connection. The landing connection enables the gondola to rotate in a set plane towards the rig mast for aligning and misaligning the gripped tubulars with the centerline of the wellhead.

In a broad aspect of the invention, a system is provided for moving tubulars between a rig mast and a supply rack of tubulars and for aligning a tubular with a centerline of a wellhead. The system comprises a gondola suspended from and movable along a load cable extending between the rig mast and the supply rack. The gondola has grippers for releasably gripping the tubular and a first landing coupler attached thereto for releasably coupling with a second landing coupler which is adapted for support on the rig mast. The first landing coupler and second landing coupler form a landing connection. The landing connection enables the gondola to rotate in a controlled, set plane towards the rig mast, the set plane being aligned with the centerline of the wellhead. Accordingly, gondola is rotated to received and deliver tubulars aligned with the wellhead.

The provided system enables a method, which in a broad aspect comprises suspending a gondola having grippers for gripping tubulars, from a load cable extending between the rig mast and the supply rack. Moving the gondola along the load cable. Releasably coupling the gondola to the rig mast at a first landing connection between compatible couplers on the gondola and the rig mast; and rotating the gondola at the first landing connection in a set plane for aligning and misaligning the grippers with the wellhead.

DETAILED DESCRIPTION OF THE PREFERRED EMBODIMENTS

With reference to FIGS. 4*a* to 6, an embodiment of a system is shown for moving tubulars 50 between a rig derrick or mast 11 and a supply of pipe. The pipe could be supplied from a supply rack at the ground, mobile pipe racks, or other form of rig catwalk 12. The mast 11 is positioned over a wellbore W into which the tubulars are run in and tripped out. Herein, the term tubular can include a variety of drill pipe, collars and casing and references to drill pipe embodiments includes other forms of tubulars. Further, the term cable includes other tension members including chain which can support the transport and movement of suspended structure therealong.

This system, while maintaining the advantages of a mechanical pipe arm of the prior art, is also capable of handling single, double and even triple stands of drill string tubulars 50. A gondola 20 of a cableway transport system is suspended on one or more cables for shuttling tubulars 50 to and from a supply of tubulars and the mast 11. At the mast 11, the gondola 20 cooperates with compatible structures adapted to the mast 11 to align the tubulars 50 with the wellbore W.

Figure 1:
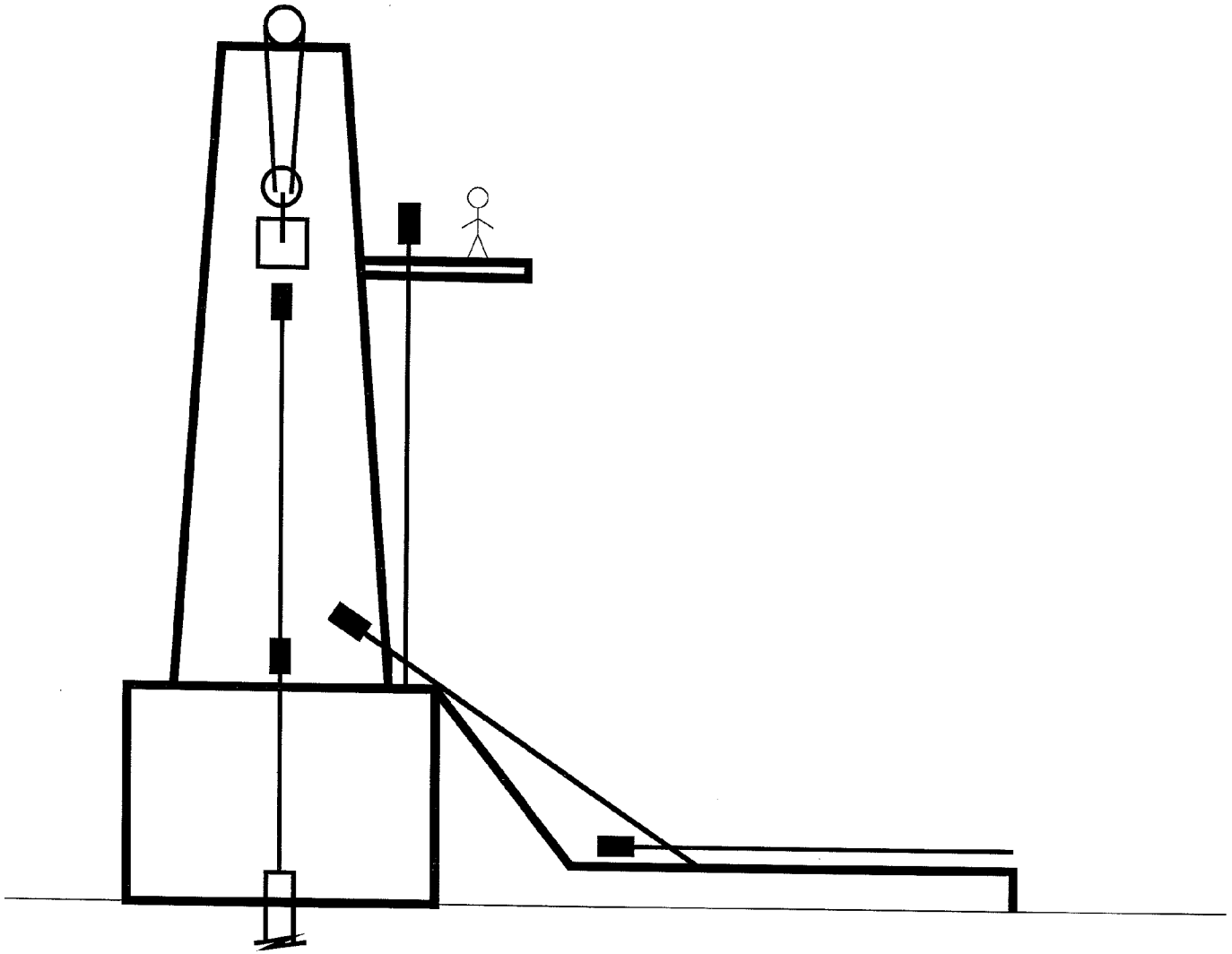
Fig. 1 Prior Art
FIG. 1 is a schematic representation of a conventional drilling rig, illustrating a drilling rig mast having a substructure for a racking board and a derrickman, a drilling rig catwalk, a v-door and various tools such as a top drive.
Figure 2:
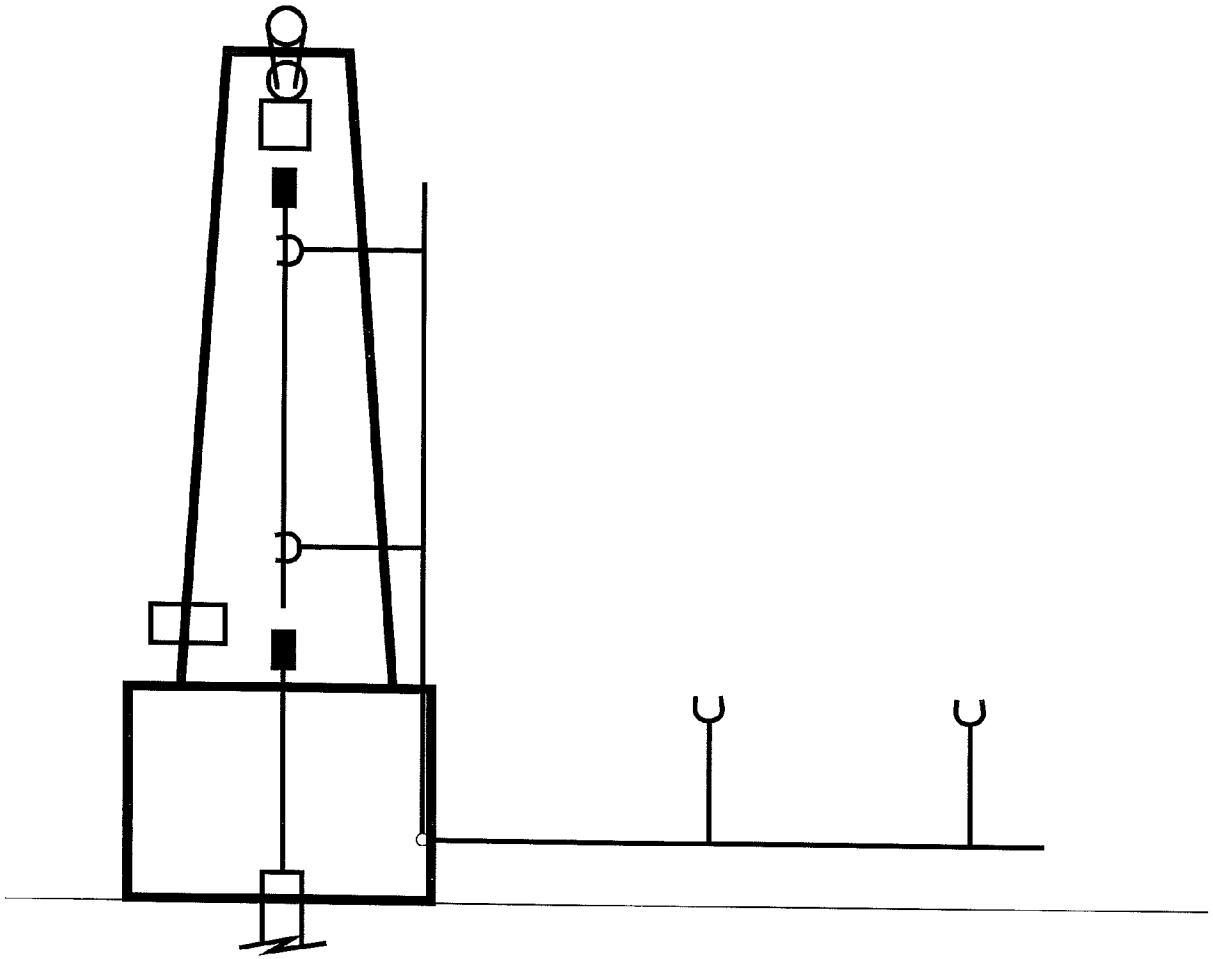
Fig. 2 Prior Art
FIG. 2 is a schematic representation of a pipe arm type pipe handling system used on single rigs. Shown is a hydraulic pipe arm having grippers for gripping drill string tubulars and lifting them into position and aligning over a centerline of a wellhead.
Figure 3:
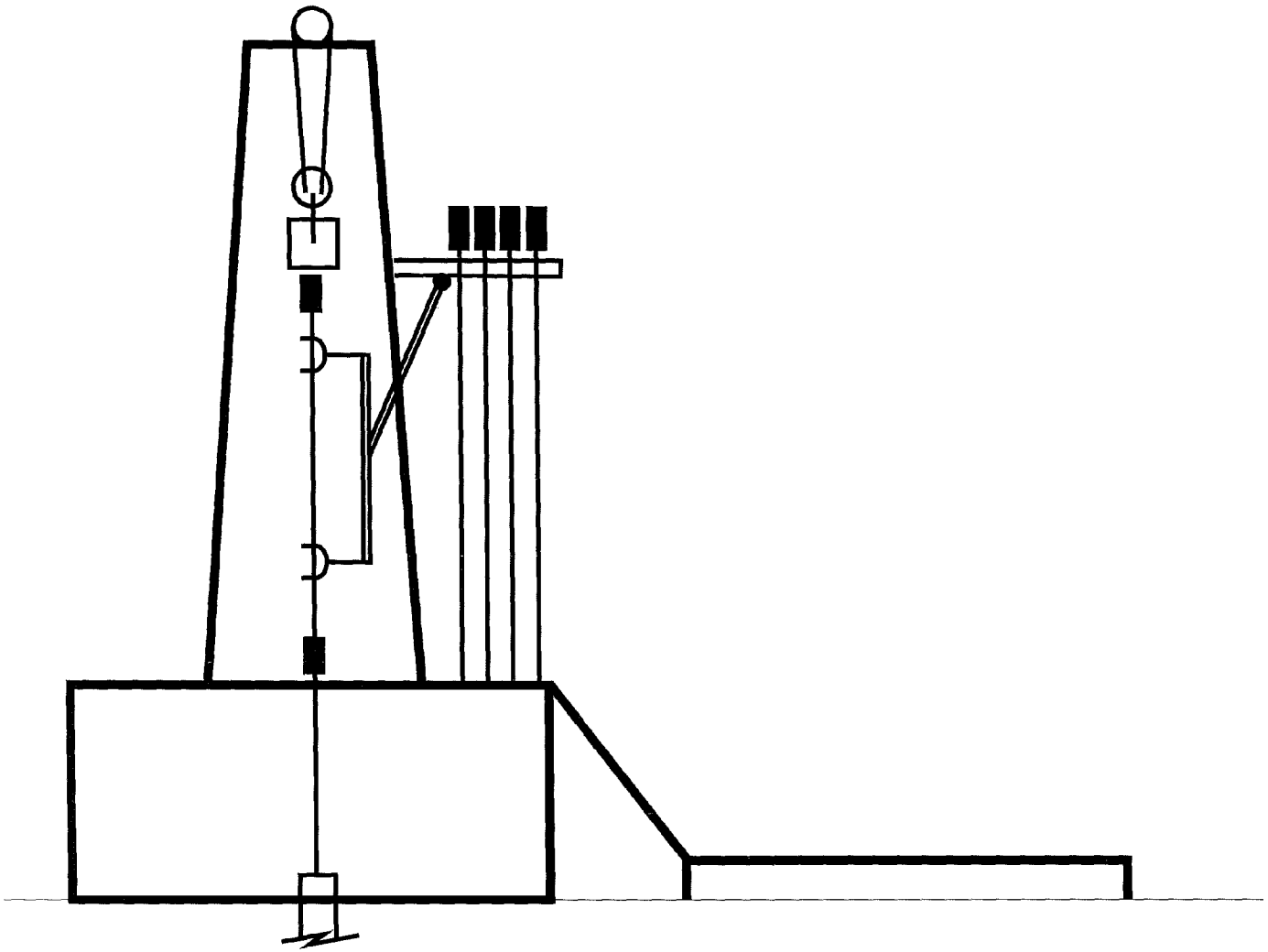
Fig. 3 Prior Art
FIG. 3 is a schematic representation of a conventional drilling rig having a hydraulic pipe arm attached to the racking board. This pipe arm is used to assist during tripping in/out procedures to the racking board. This pipe arm does not assist during laying down of pipes.
Figure 4A:
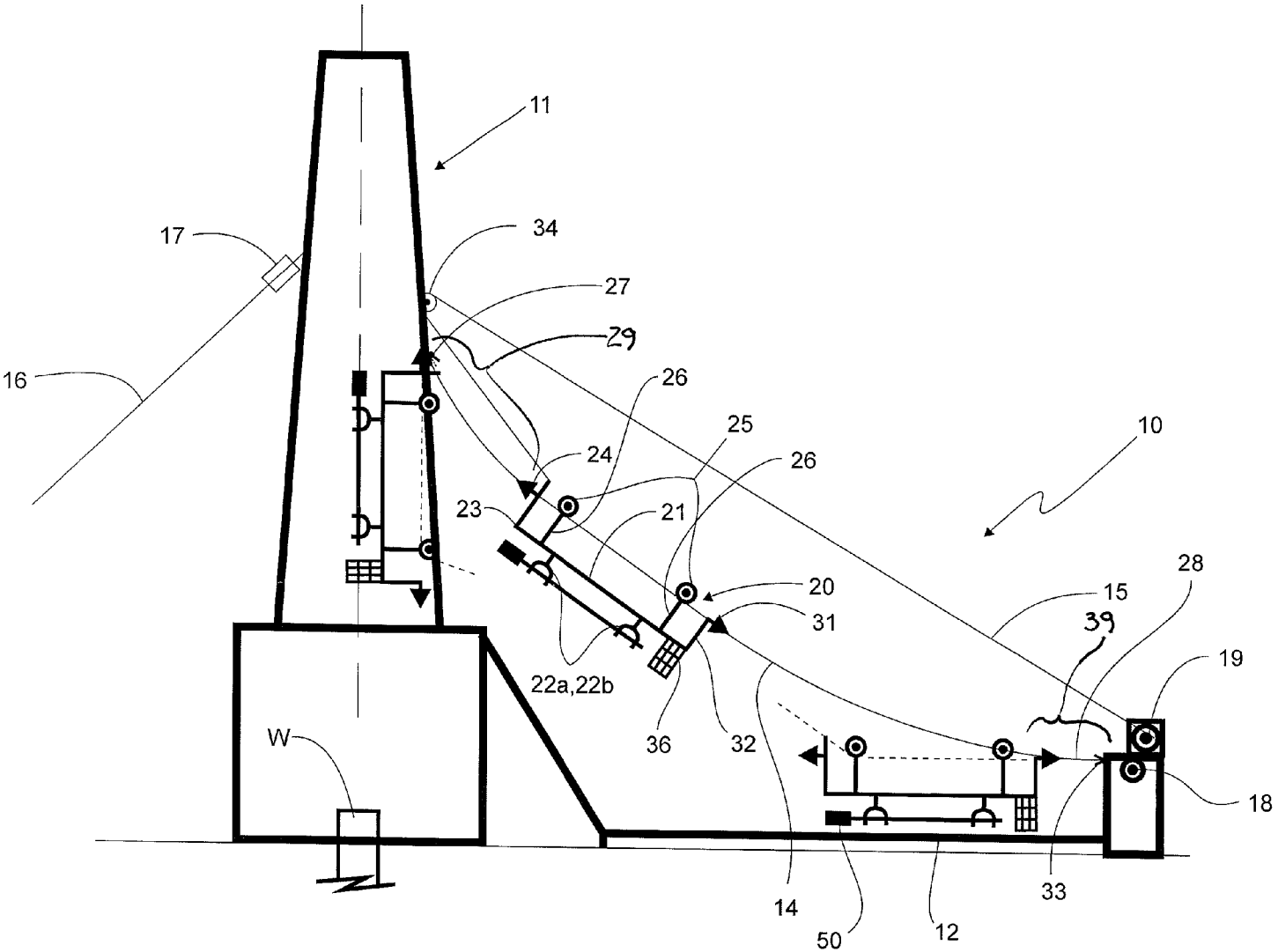
FIG. 4*a* is a side view, schematic representation of an embodiment of this present invention, shown in three positions, illustrating a gondola suspended and movable along load cables for transporting drill string tubulars from a drilling rig catwalk to a drilling rig mast. The gondola is shown picking up a tubular at the catwalk, moving between the catwalk and mast, and shown aligning the tubular over wellhead.
Figure 4B:
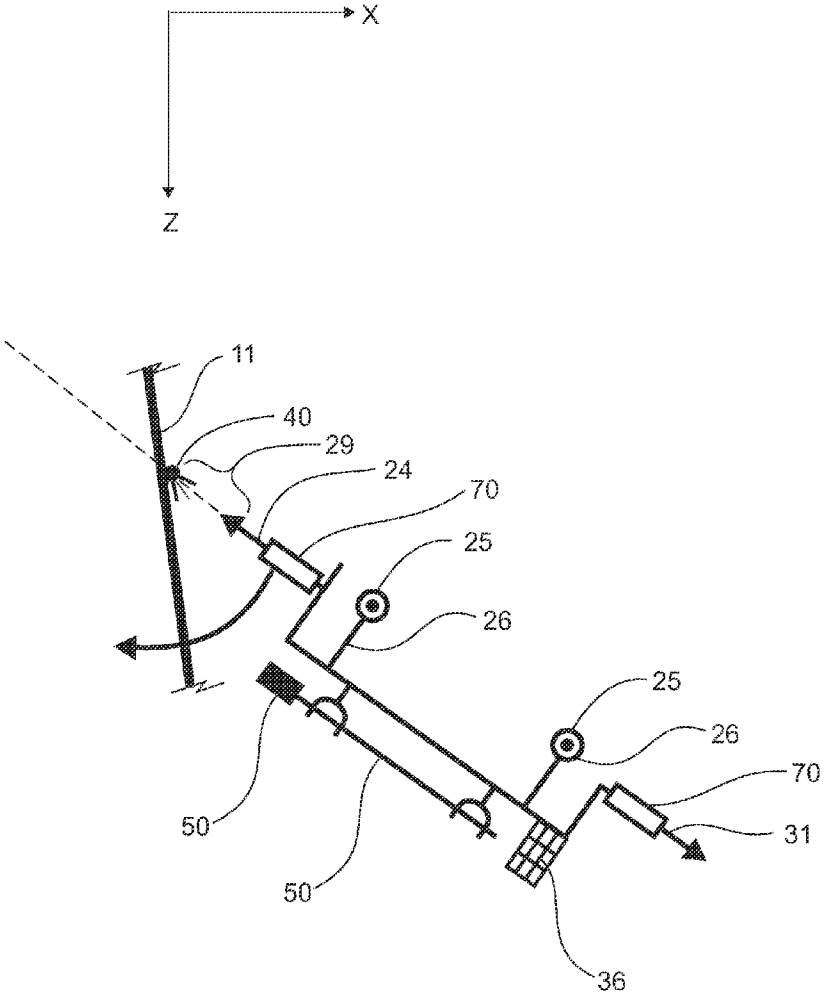
FIG. 4*b* is a schematic representation of the embodiment according to FIG. 4*a*, showing the rotation of the gondola in a set plane.

With reference to FIG. 4*a*, and in one embodiment, a system 10 for handling a joint or stand of multiple joints or tubulars comprises the gondola 20 which is suspended and movable along one or more load cables 14 extending between the mast 11 and the catwalk 12. Herein, tubulars refers to one joint or multiple joints of tubulars 50. The gondola 20 is movably suspended from the load cable 14, such as by suspension structure 26 which is terminated with cable-engaging wheels or rollers 25.

Gondola loads on the mast 11 can be counterbalanced as necessary using one or more guy lines 16 extending between the ground and side of the drilling rig mast opposing the system 10. Guy lines 16 can be fit with an actuator 17 for adjusting the tension applied thereto.

The gondola 20 has a structure or frame 21 from which at least a pair of grippers 22*a*, 22*b* are supported thereon for releasably gripping tubulars 50. The grippers 22*a*, 22*b* are spaced apart in an axial direction of the gondola.

A hoist cable 15 moves the frame 21 along the load cable 14. The hoist cable 15 is secured to the frame 21 at its first end 23 and extends between the frame 21, a sheave 34 on the mast 11, and a hoist winch 19 at the catwalk 12. A load cable winch 18 can increase or decrease the tension applied to the load cables 14*a*, adjusting the position of the frame 21 as required. Alternate positions of the load cable 14 and gondola 20, in a slack or loosened condition, are shown in dotted lines.

The suspended load cables 14 are inherently mobile and accommodation is provided at the interface of the mast 11 and the gondola 20 to guide and manipulate the gondola 20 and carried tubular 50 for precise alignment with the wellbore. Simply, a connection can be made between the gondola 20 and the mast 11 for rotating the gondola and carried tubular along a set plane (shown in FIG. 4*b*) for aligning the tubular with the wellhead.

More particularly, a first landing coupler 24 is supported on a first end 23 of the frame 21. A second landing coupler 40 is adapted for support on the mast 11. The second landing coupler 40 can be clamped to the mast 11 to avoid modifications thereto. When the gondola 20 approaches the mast 11, the first landing coupler 24 is received by and releasably engages the second landing coupler 40 forming a first landing connection 29. The first landing connection 29 positions the gondola 20 in a set position and permits controlled rotation of the gondola relative to the mast. The first landing connection 29, through one of either the first or second landing couplers 24, 40, or the combination thereof, enables pivoting of the gondola 20 relative to the mast 11.

Figure 5:
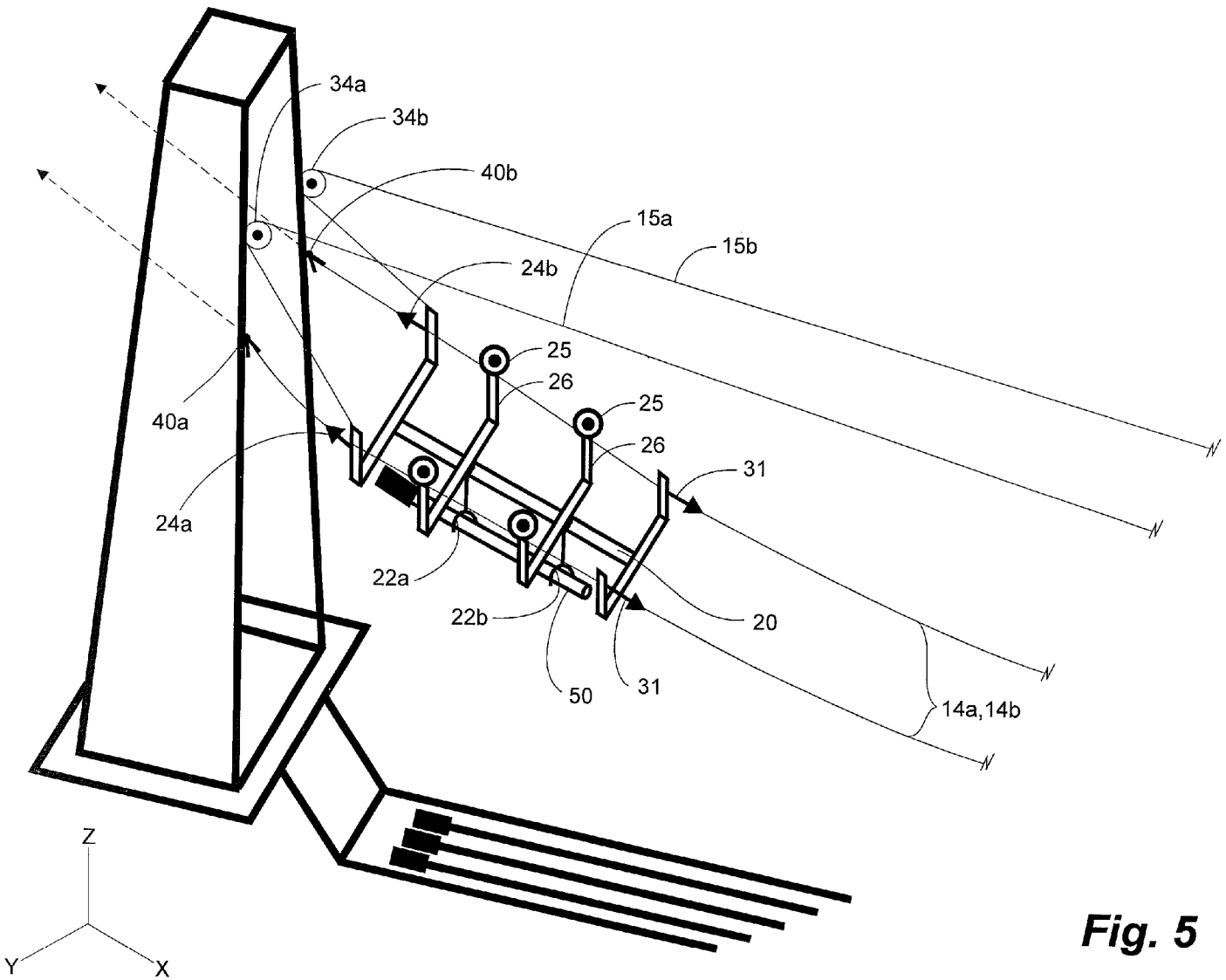
FIG. 5 is a perspective and schematic representation of the embodiment of this present invention according to FIG. 4*a;*

In the embodiment shown in FIG. 5, the load cable 14 can be a pair of load cables 14*a*, 14*b* which adds to lateral stability. Each of the load cables 14*a*, 14*b* has a mast end 27 anchored to the mast 11, and a winch end 28 spooled onto a load cable winch 18 (FIG. 4*a*). A pair of second landing couplers 40*a*, 40*b* are supported on the mast 11. The pair of second landing couplers 40*a*, 40*b* can be located at substantially coincident attachment points as the mast end 27 of the load cables 14*a*, 14*b* for ease of guiding a corresponding pair of first landing couplers 24*a*, 24*b* to the second landing couplers 40*a*, 40*b* for releasably coupling thereto. The gondola 20 is moved between its end positions by the hoist cable 15 or a pair of hoist cables 15*a*, 15*b*.

Both load cable winch 18 and hoist winch 19 can be powered by either AC variable frequency drives or servo-controlled hydraulic motors. The position control can be achieved with a computer based control system.

Figure 7:
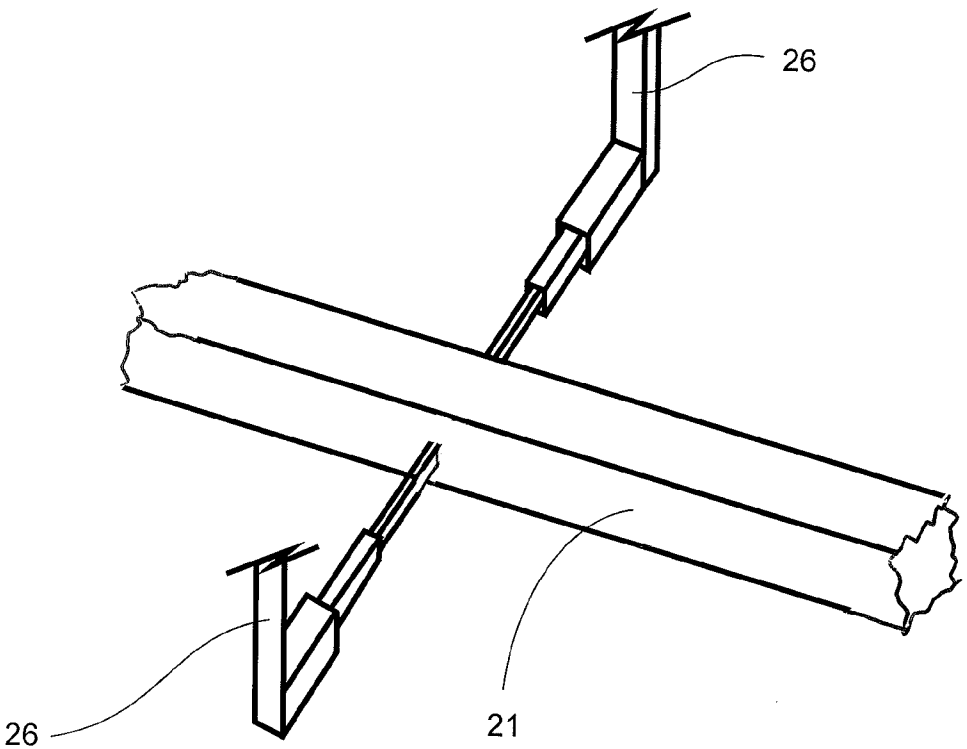
FIG. 7 is a schematic representation of an embodiment of a gondola of this present invention having a telescoping suspension structure.

Advantageously, the point of attachment of the mast ends 27 of the load cables 14*a*, 14*b* can be adjusted to custom fit each individual drilling rig and thus can be retrofitted to existing drilling rigs in operation. The load cables 14*a*, 14*b* can be substantially parallel to each other or have a lateral distance between the two cables that can vary such as when the width of the mast 11 is different than the catwalk 12. Typically, the mast 11 is wider than the catwalk 12 and the lateral spacing or distance between each of the load cables 14*a*, 14*b* increases as one moves from the catwalk 12 to the point of attachment of the mast ends 27 at the mast 11. Accordingly, as shown in FIG. 7, the gondola suspension structure 26 adapt to varying lateral distance such as by telescoping to laterally extend and contract as the lateral distance varies.

Alternatively, the narrower of the mast 11 or the catwalk 12 can be provided with outrigger structure with terminating sheaves to make the load cables parallel with one another. Closely set winches could be angled or swivelled to take up the cables.

Accordingly, in another embodiment in which the first landing couplers 24*a*, 24*b* are incorporated into the gondola suspension structure 26, the pair of first landing couplers 24*a*, 24*b* can be telescopically coupled to laterally extend and contract as the lateral distance varies.

Figure 6:
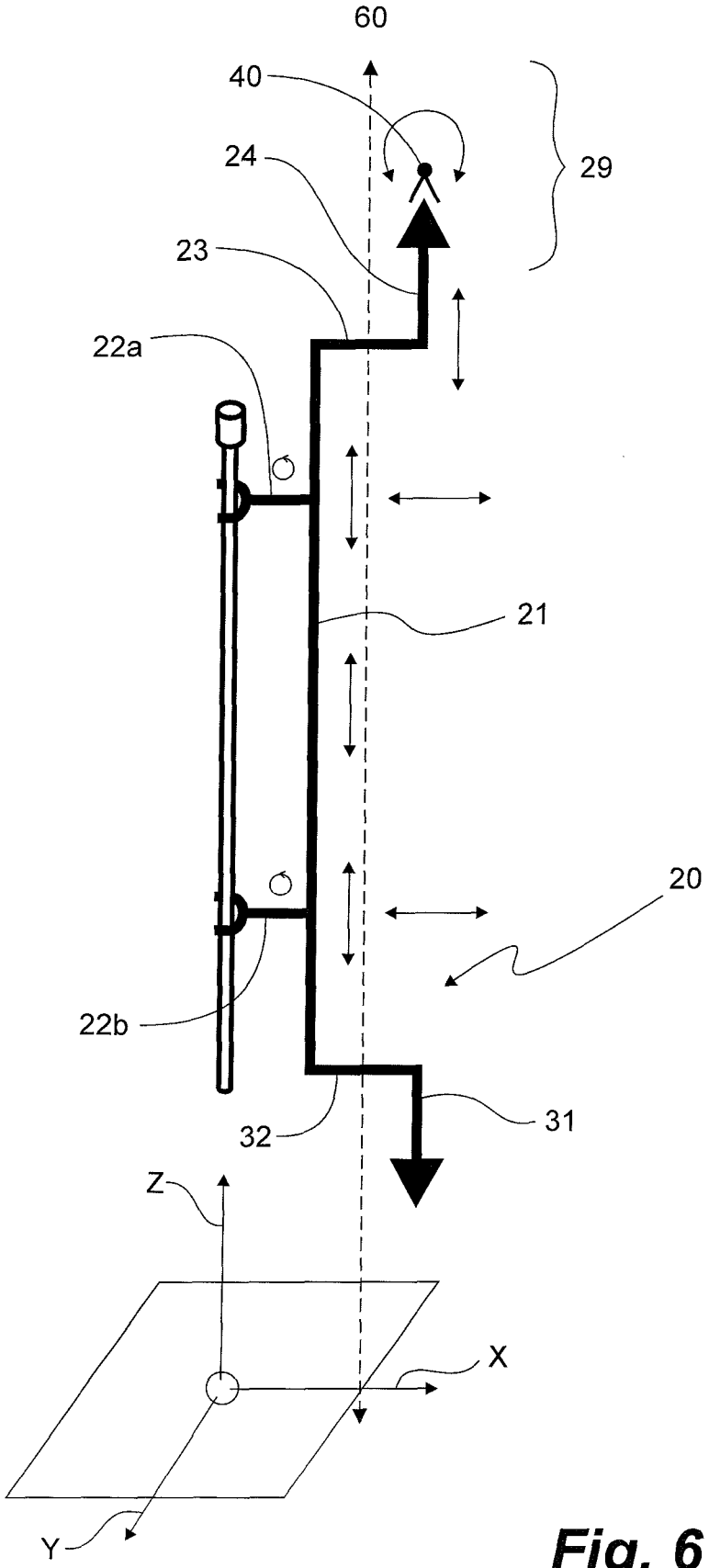
FIG. 6 is a schematic representation of an embodiment of a gondola of this present invention, releasably coupled to a first landing coupler, illustrating the various independently adjustable motions associated with each individual component of the gondola.

With reference to FIG. 6, the gondola 20 is coupled to the second landing coupler 40 at the mast 11. As illustrated, the frame 21 has a first end 23 supporting the first landing coupler 24. The first landing coupler 24 is shown received and releasably coupled to the second landing coupler 40 forming the landing connection 29.

Figure 8A:
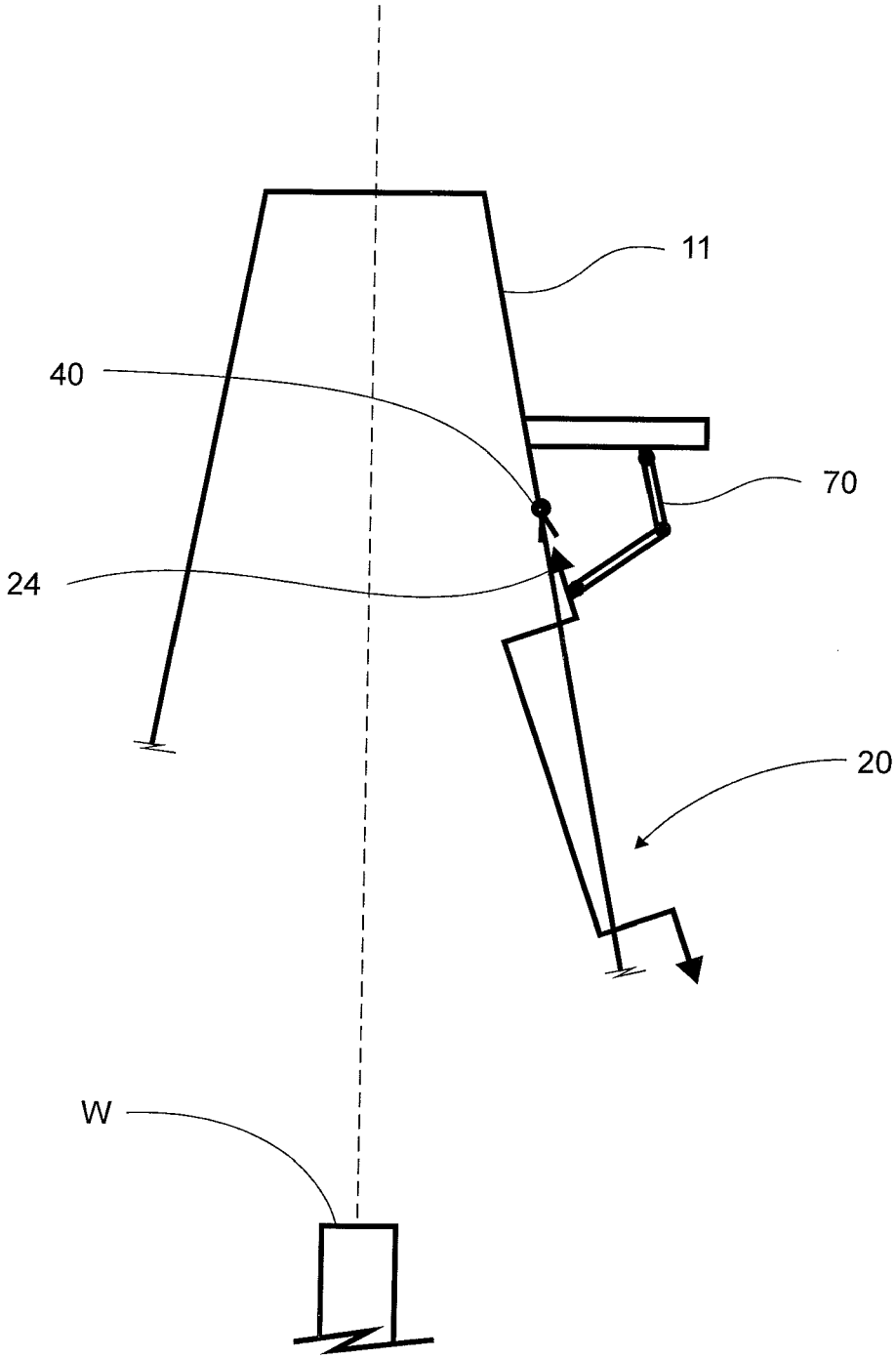
FIGS. 8*a* and 8*b* are schematic representations of an embodiment of this present invention having an actuator for actively assisting the rotation of the gondola within the rig mast.
Figure 8B:
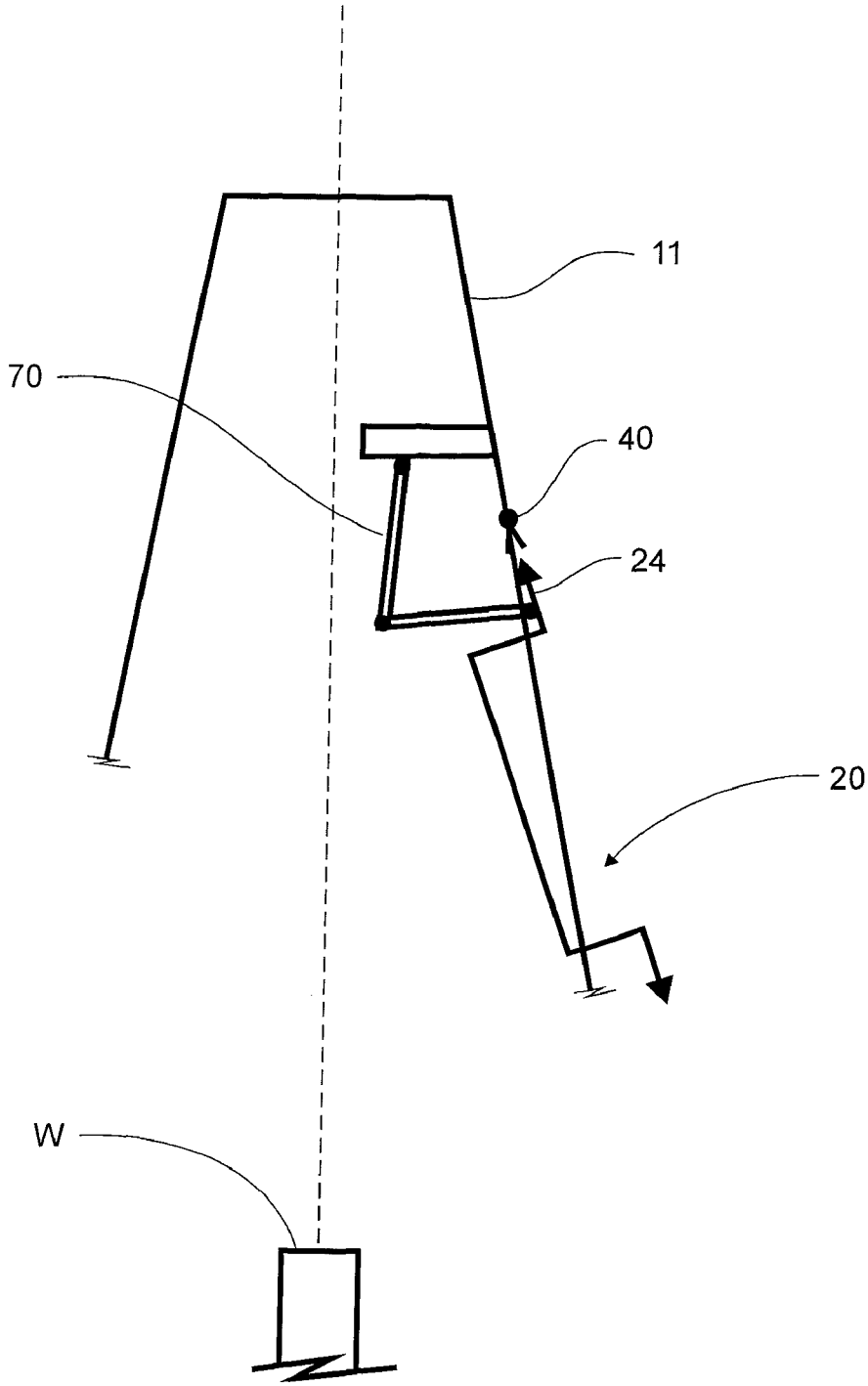

The landing connection 29 has rotational movement about the Y-axis allowing the gondola 20 to rotate in a set plane, shown as the Z-X plane, towards and away from the mast 11. As shown in this embodiment, the second landing coupler is pivotally connected to the mast 11 although the pivot could alternately be provided at the gondola. When the load cables 14*a*, 14*b* are loosened, the gondola 20 rotates to align the tubular 50 with the wellhead. The gondola may rotate under its own weight. In some designs or circumstances, the centre of gravity of the gondola 20 and gripped tubular 50 may not fully enable the tubular to align with the wellhead W. In such circumstances, assistance such as an actuator 70 can be engaged between the mast 11 and the gondola 20 to actively assist to rotate the gondola within the mast 11. As shown in FIGS. 8*a* and 8*b*, such actuators 70 could include manipulation of the second landing coupler 40 or engagement between structure on the mast and the gondola.

In various embodiments, each individual component of the frame 21 can have certain adjustable capabilities to aid in the overall positioning and alignment of a drill string tubular over the centerline of the wellhead. For example, the grippers 22*a*, 22*b* are capable of adjusting their position in all three dimensions X, Y, Z. For example, grippers 22*a*, 22*b* can each be individually adjusted along the Z-axis such that the distance between each of the grippers 22*a*, 22*b* can be increased or decreased according to the length of a drill string tubular or moved together to adjust the location of the tubular relative to the frame. The grippers 22*a*, 22*b* can also be adjusted along the X-axis, increasing or decreasing the distance between a gripped drill string tubular and the frame 21. Further, the grippers 22*a*, 22*b* can be adjusted laterally along the Y-axis allowing for finer adjustments in aligning the tubulars over the centerline of the wellhead.

In Operation

Generally tubulars are moved between the mast and the supply rack comprising suspending the gondola from the load cable extending between the mast and the supply rack or catwalk, gripping a tubular from an underside of the gondola and moving the gondola and the tubular along the load cable. The gondola is releasably coupled to the mast at a landing connection made between compatible couplers on the gondola and the mast. The gondola is rotatable at the landing connection for aligning the tubular with the wellhead.

Stabbing or Tripping In

With reference to FIGS. 4*a* and 5, the gondola 20 begins at an initial position above the supply of tubulars or catwalk 12. In this position, the load cable winch 18 is slacked off to decrease the tension applied to the load cables 14*a*, 14*b* (dotted lines), allowing the gondola 20 to drop to a position above the tubulars 50. The grippers 22*a*, 22*b* grip a tubular 50. The gondola 20 and gripped tubular is raised off the catwalk 12 by increasing the tension applied to the load cables 14*aa*, 14*ab*. Hoist winch 19 pulls the gondola 20 from the catwalk 12 towards the mast 11.

The pair of first landing couplers 24*a*, 24*b* engage the pair of second landing couplers 40*a*, 40*b*. Where the load cables

14*a*, 14*b* are aligned with both the first and second landing couplers, the second landing couplers 40*a*, 40*b* are guided directly to the first landing couplers 24*a*, 24*b* which releasably engage and couple as the landing connection 29. The landing connection 29 operatively connects and sets the gondola 20 movement relative to the mast 11.

The tension in the load cables 14 can be reduced, enabling the gondola to swing towards the mast 11. The landing connection 29 permits the gondola 20 to rotate in a set plane towards the mast 11 with the expectation the tubular will become substantially aligned with the centerline of the wellhead W. During rotation of the gondola 20, the load cable winch 18 continues to decrease the tension applied to load cables 14*a*, 14*b* allowing the gondola to freely rotate and position itself above the wellhead.

The grippers 22*a*, 22*b* can be individually manipulated to refine the gripped tubular's position for aligning the drill string tubular 50 over the centerline of the wellhead to within ¼" to ⅛" of the centerline.

The fine alignment and setting of the tubular 50 to a position above the centerline of the wellhead allows for the consistent and repetitive alignment of subsequent drill string tubulars over the centerline of the wellhead thereafter.

The positioning of the grippers 22*a*, 22*b* can be pre-determined once the gondola/catwalk and gondola/mast geometry is known, such as during initial operations. Accordingly, operations can be repeated as many times as necessary and with consistency, without having to individually align each and every subsequent tubular, saving time and money, and more importantly reducing the opportunities of harm to any derrick workmen.

Tripping Out

For operations where drill string tubulars are withdrawn, the procedure for running-in is reversed. The gondola 20, set in the first landing connection 29, is aligned over the centerline of the wellhead and positioned to receive a tubular tripped out from the wellhead. After gripping the withdrawn tubular, the tubular connection to the drill string is unthreaded and the first landing connection 29 enables rotation of the gondola 20 and tubular 50 up and away from the mast 11, misaligning the tubular with the wellhead. The first landing connection 29 can be de-coupled wherein the first and second landing couplers 24, 40 disengage from each other, freeing the gondola 20 from the mast 11. The tension of the load cable 14 can be increased and the gondola 20 returned to a position above the catwalk 12 for racking the tubular at the catwalk. This process is repeated as many times as necessary.

Additional Embodiments

Repairs or services can be performed while the gondola is positioned above the drilling rig catwalk. This is advantageous as mechanics can stand on the catwalk and safely work at a normal height, and not 80 feet up on the drilling platform as is required with other racking systems. Welding cables and other repair machinery is all readily available on the catwalk at ground level and increases the safety of the mechanics performing the repairs or services. This is a particular advantage in harsh climates where any work up high on the drilling platform is difficult.

Figure 9A:
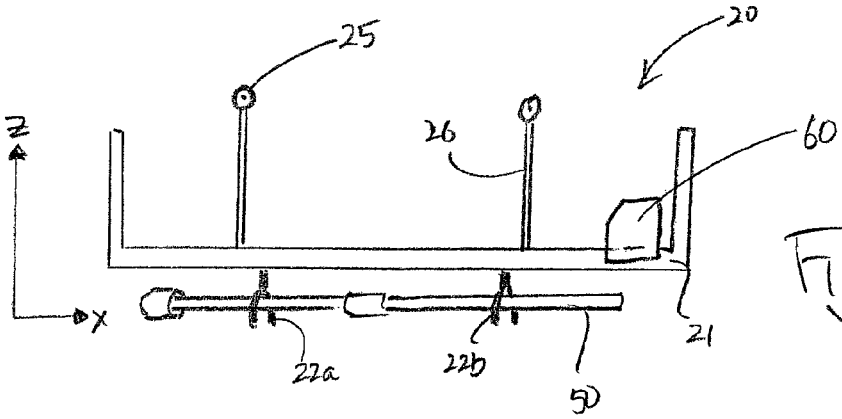
FIGS. 9*a*-9*c* are schematic representations of an embodiment of the gondola of this present invention, illustrating an operator's cabin that swivels as the pitch of the gondola changes.
Figure 9B:
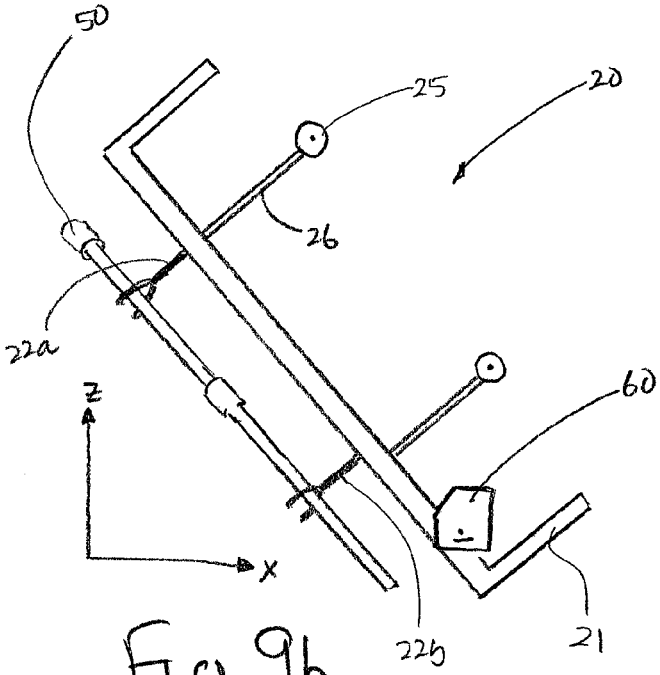
Figure 9C:
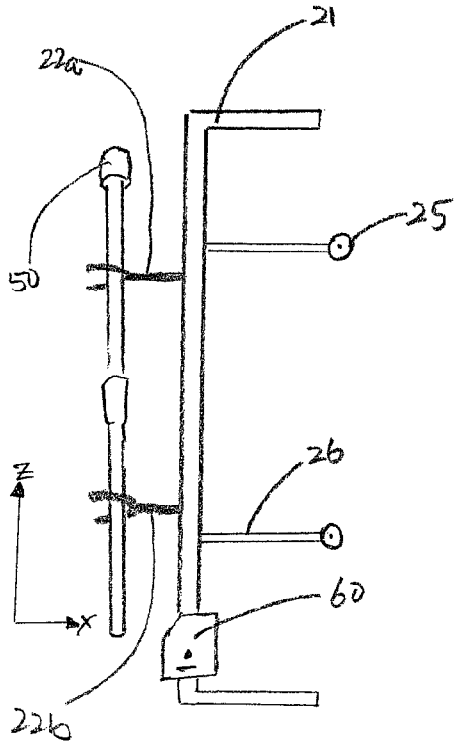

Most pipe handling equipment is typically operated from a position in the "dog house", a driller operating cabin. The present system can also accommodate a cabin with the gondola. It is beneficial for safety reasons if the operator can be located in a position where the operator can easily see the catwalk as well as the drill floor. The gondola can be adapted to house an operator's cabin 60 directly on the frame, allowing the operator to ride up and down with the drill string tubular allowing the operator to visually oversee the picking up (or dropping off) tubulars on the catwalk and the make/break and spin operations on the drill floor. As shown in FIGS. 9*a*-9*c*, the operator's cabin could be adapted to swivel as the pitch of the gondola changes as the gondola moves from the catwalk to the mast.

In another embodiment, the frame 21 may include a powered cable drive for engaging the load cables 14*a*, 14*b* and moving the gondola 20 therealong. In such an embodiment, the hoist cable is not required.

Still, in another embodiment, the frame 21 can be fit with a power wrench 36, such as an iron roughneck alignable with the gripped tubular, for making and breaking threaded tubular joints. Particular advantage is gained by using the power wrench when stabbing the tubular to the stump extending from the rig floor. The tubular is already aligned with the centerline of the wellbore and the power wrench can be used to make or break the joint without need to engage the rig's own iron roughneck.

For better control of the gondola 20 at the catwalk, a third landing coupler 31, supported on a second end 32 of the frame 21, can be received by and releasably engage a fourth landing coupler 33 supported on the catwalk 12. The third and fourth landing couplers 31, 33 engage each other forming a second or catwalk landing connector 39 for controlling the gondola movement at the catwalk similar to that provided at the landing connector 29 at the mast 11. The third landing coupler can be a pair of third landing couplers supported by the gondola, adapted to be received and releasably coupled to a pair of fourth landing couplers disposed on the catwalk.

One or both of the landing connectors, the first landing connector 29 and the catwalk landing connector 39, can be fit with an oleo or shock absorber system 70, similar to those found on automobiles or airplanes to buffer engagement of the moving gondola 20 received at the mast 11 or catwalk 12 respectively. The shock absorber system 70 is provided on one of the mast or frame and at one of the frame and catwalk. The shock absorber system also smoothes and limits vibration that could otherwise be transmitted therethrough.

In cases where the cable system could swing, such as over long cable runs or in high wind conditions, the gondola 20 can be further stabilized using an on-board control system implementing active counterweights on the frame 21. The active counterweights can be programmed to shift and counteract any lateral motion that the gondola is subjected to. This is particularly useful for larger rigs, particularly open-face jack-knife-style derricks, having wide derricks often as large as 18-20 feet at the base. Further stability can be achieved at the ends of the cable runs by implementing extending hydraulically actuated alignment arms that extend between the gondola 20 and mast 11.

The embodiments of the invention for which an exclusive property or privilege is claimed are defined as follows:

1. A system for moving tubulars between a supply of tubulars and a drilling rig positioned over a centerline of a wellhead comprising:

a drilling rig mast positioned over the centerline;

a load cable extending between the mast and the supply;

a gondola suspended from the load cable and movable therealong for shuttling the tubular between the supply and the mast, the gondola having, a frame with an axial direction aligned with the load cable, and two or more grippers supported on the frame and spaced apart along the axial direction for gripping the tubular;

a pair of first landing couplers supported on the frame; and a pair of second landing couplers supported on the mast for releasably engaging the pair of first landing couplers for coupling the gondola to the mast for forming a rotatable landing connection, wherein the gondola is rotatable at the landing connection in a set plane towards centerline for positioning and aligning the gripped tubular thereover.

2. The system of claim 1, wherein the pair of second landing couplers are substantially parallel and laterally spaced apart on the rig mast.

3. The system of claim 1 wherein the grippers are individually adjustable to aid in the positioning of the tubular to the centerline of the wellhead.

4. The system of claim 1 wherein the grippers are attached to an underside of the frame.

5. The system of claim 1 wherein the load cable is a pair of load cables having lateral spacing.

6. The system of claim 5, wherein each load cable of the pair of load cables has a mast end attached to the rig mast, and a winch end attached to a load cable winch disposed on the supply, wherein each mast end is substantially coincident with each of the pair of second landing couplers.

7. The system of claim 5 wherein the frame further comprises a telescopic gondola suspension structure for adapting to the lateral spacing between the pair of load cables.

8. The system of claim 1 further comprising a hoist cable, extending between the gondola, the rig mast, and the supply, for moving the gondola between the supply and the rig mast.

9. The system of claim 1 further comprising a third landing coupler supported by the gondola, adapted to be received and releasably coupled to a fourth landing coupler disposed at the supply.

10. The system of claim 9, wherein the third landing coupler is a pair of third landing couplers and the fourth landing coupler is a pair of fourth landing couplers, the pair of third landing couplers being substantially parallel and laterally spaced apart on the gondola.

11. The system of claim 1 further comprising a powered cable drive supported by the gondola for engaging the load cable for moving the gondola between the supply and the rig mast.

12. The system of claim 1 further comprising actuators supported on the rig mast and adapted to engage the gondola for aiding in rotating the gondola.

13. The system of claim 1 wherein the gondola further comprises a power wrench for making or breaking tubulars.

14. The system of claim 1 wherein the gondola further comprises an operator's cabin.

15. The system of claim 1 wherein the gondola further comprises means for absorbing shock for buffering engagement of the moving gondola received at the mast or at the supply.

* * * * *